United States Patent [19]

Várkonyi et al.

[11] Patent Number: 4,804,293

[45] Date of Patent: Feb. 14, 1989

[54] FLEXIBLE LAYER STRUCTURE FOR PROTECTING EARTHWORKS, BED WALLS AND FOR DELIMITING EMBEDDING LAYERS

[75] Inventors: László Várkonyi; Gyula Váci, both of Miskolc, Hungary

[73] Assignee: Comporgan Rendszerhaz K.V., Budapest, Hungary

[21] Appl. No.: 6,967

[22] Filed: Jan. 27, 1987

[30] Foreign Application Priority Data

Jan. 28, 1986 [HU] Hungary ..... 388/86

[51] Int. Cl.[4] ..... E02B 3/04

[52] U.S. Cl. ..... 405/15; 405/19; 405/258; 428/117; 428/118; 428/137; 428/224; 428/247; 428/913

[58] Field of Search ..... 405/258, 262, 15, 19; 428/117, 119, 137, 138, 224, 109, 283, 247, 913

[56] References Cited

U.S. PATENT DOCUMENTS 4,137,353 1/1979 Fariello ..... 428/116

*Primary Examiner*—James J. Bell

*Attorney, Agent, or Firm*—Schweitzer & Cornman

[57] ABSTRACT

The invention relates to a layer construction formed as a net for the protection of earthworks, constant or periodical water courses, steep area surfaces, for building dams and embankments, for the laterial delimitation of materials tending to spreading, as e.g. sludges, soaked embedding materials. The net to be built-in into the protective layer or earthwork is fixed to the substructure of compacted soil by means of proper fixing elements. After having filled the meshes of the net with a filler, the confining walls of the meshes are carrying the load and stresses acting on the surface. The structure according to the invention follows the motion, consolidation of the earthwork and the substructure flexibly, without getting damaged. The side-walls made of a geotextile are staying in the path of water flow streaming on the surface or next thereto, thus reducing velocity and energy of streaming sickering water; soaked embedding materials of dams and dikes are kept together, neither earthworks nor field surfaces become damaged, materials with a high water content cannot be spread, sludge and soaked ballast bed are protected.

By using the structure according to the invention, by using natural materials, as earth, gravel, rocks, sludge, stable crusts and layers can be formed in earthworks, dams, dikes and embeddings well resisting to soil-mechanical stresses and surfacial effects.

4 Claims, 1 Drawing Sheet

Figure 1:
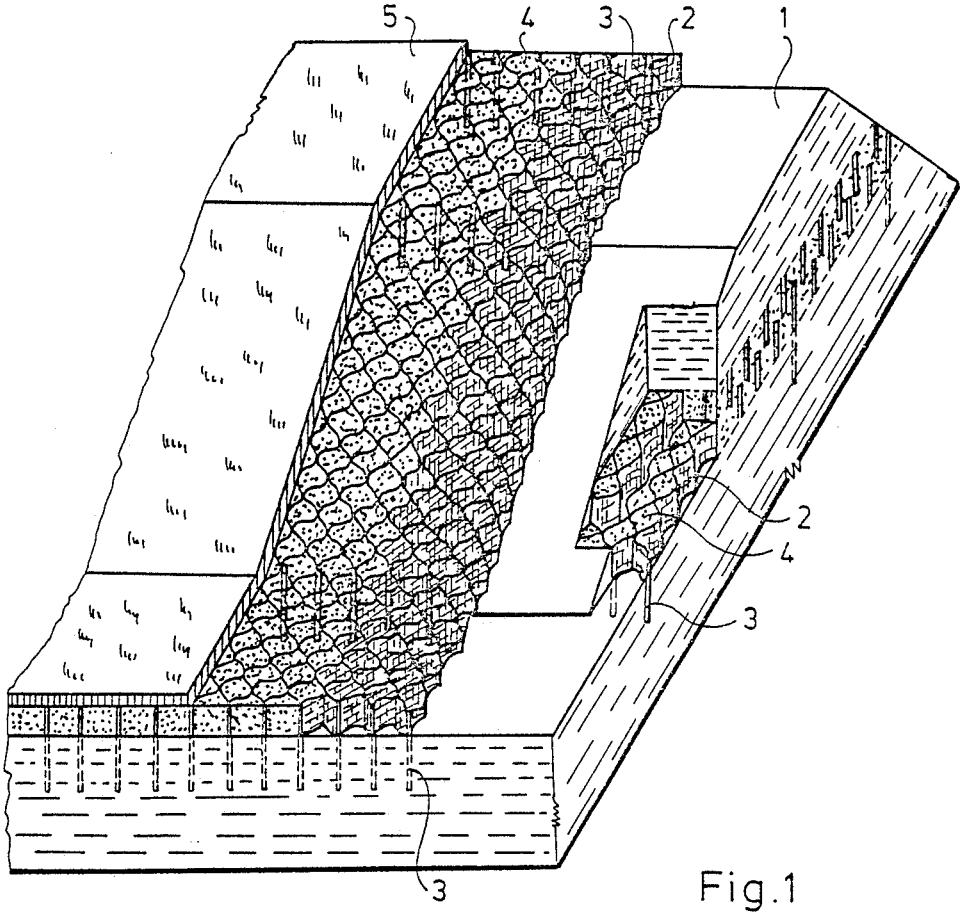

FLEXIBLE LAYER STRUCTURE FOR PROTECTING EARTHWORKS, BED WALLS AND FOR DELIMITING EMBEDDING LAYERS

The invention relates to a surfacial layer structure made with a geotextile, the task of which is to protect against the harmful effect of wind, water and media streaming on the surface of earthworks and beds with constant or periodical water courses, as well as to delimit embedding materials of the substructure, foundating of objects serving for traffic purposes, thus hindering deterioration of the embedding layer.

The layer structure according to the invention is forming a crust on the surface to be protected, while the thickness is to be dimensioned so as to be in compliance with the expectable stresses.

The surfacial layer structure according to the invention can be advantageously used for the protection of earthworks, dams, embankments, side slopes, waste rock piles, of slope walls of flyash-bunkers, for mountain entrapment, for reinforcing and binding beds of rivers and brooks, for making coatings of dikes, for binding arable soil subjected to erosion, as well as for protecting and delimiting embedding materials of objects serving for traffic purposes, protecting ballast beds of roads and railways against spreading, for the biological protection of steep terrain surfaces and promoting planting of trees on mountain sides.

None of the known processes aimed at the protection of earthworks, as applying a top-soil of humus, grassing, coating with different materials incorporates a solution, which could ensure a structural bound between the protective layer having been applied onto the surface and the soil lying below, already in course of construction.

Protection against slipping and displacement ought to be achieved by the friction arising between the protective layer applied and the soil lying beneath, which decreases under the effect of moisture and water arriving at the surface, the protective layer is slipping down, the coating gets broken and the surface of the earthwork left unprotected becomes considerably damaged by erosion.

The known coating using PVC /polyvinylchloride/ or PE /polyethylene/ in form of synthetic foils, often used for coating beds and flood-protective dikes against leakage becomes easily damaged and loses—as experiences have shown—its favourable character in a rather short time. The foil used to be covered with an earth layer, however, the friction between foil surface and the covering layer does not suffice for maintaining soundness of the protective layer, the layer slides down, while the foil left uncovered becomes damaged under solar and other thermal effects and destruction due to erosion begins at the surface of the earthwork. Research activities and development directed to roughen the foil surface are known, so e.g. "Soil mechanics - case studies" /Kézdi, Árpád, 1978/ deals in detail with said problems.

The publication "Transportnoe Stroitelstvo"/Moscow, 1983/8/, as well the abstract thereof published in Hungarian in the Technical and Economic Information of Building Affairs /1983/12/ inform us about a coating process using a cloth with synthetic fivre reinforcement. In course of the process a carpet made with synthetic fibres is spread with overlapping. The carpet is covered with elements made of reinforced concrete or it used to be protected with an earth layer.

Although this synthetic cloth is rougher than the foil, and its mechanical properties are more favourable, but when the cloth is moistened, friction decreases to such an extent that both coating and the cloth beneath become damaged. Several practical examples are known, so e.g. in Hungary, the superhighway M7, the section between Erd and turn-out to Velence, on which slopes were covered with a synthetic cloth on several places and in such a manner that a covering layer of humus has been applied onto the synthetic cloth and the humus was grassed. On a plurality of places the covering layer slided down, radiation energy of the sun decomposed the synthetic carpet and the unprotected surface was repeatedly subjected to erosive effects.

Recently in Great-Britain a material made of polyethylene and known under the name "geogrid" was developed, which was used successfully for road construction. The highstrength grid /product of the company NETLON/ is well suitable for load distribution and reducing subsidence, as well as for distributing loads resulting from traffic on large areas. However, due to the slight thickness /1,6 mm/ it is unsuitable for surfacial protection and delimitation of the ballast bed, it is too smooth and in addition, too expensive /Strasse und Autobahn, 1984/.

In accordance with technical literature up to now protection of earthwork surfaces, protective layers covering bed walls, avoiding the slip of earth, humus, rocks and concrete plates and displacement under the effect of external stresses, precipitation, flowing water and wind etc. could not be solved.

The aim of the invention is to eliminate said known deficiencies and to develope a structural layer which partly protects the soil surfaces in itself, partly it enables a complete mechanical bond between covering layer and the soil lying beneath.

The structural layer according to the invention is based on the recognition, in so far as, if not a carpet is made of the synthetic fibre-reinforced cloth or any other cloth, geotextile, but a spatial net is prepared in a proper thickness, e.g. 10 to 40 cm, which is then spanned over the surface to be protected, fixed in the soil by means by suitable anchoring elements; after having filled the meshes of the net with natural materials, as earth, humus, rocks and gravel, we obtain a layer resp. crust structure which is well resistant to external stresses, it is flexible and fixed to the surface, and the surface of which can be covered with a thin grassed or coated shell.

With a preferred embodiment of the structural layer according to the invention geotextile strips were used, the width of which corresponded to the thickness of the net, and which were interconnected by welding or gluing. The net is stretched on the surface to be protected and fixed to the soil of the earthwork by means of stakes made of steel, a synthetic material or wood and in such a manner that the edges of the net should be well spanned. The meshes of the net are filled with earth, humus, gravel or rocks. The crust thus obtained is covered with a thin layer which can be grassed or covered with concrete plates. When protecting steep mountain sides, shrubs or trees may be planted into the meshes.

With another possible and preferred embodiment of the invention the net made of a textile is glued on or welded to the upper surface of a carpet made of a geotextile, while the bottom surface of the carpet—facing the earthwork—is covered with a foil to prevent osmose of water; thereafter the structure is stretched on the side of the dike to be protected, we fix it with the stakes and the environment of the stakes, on the place of stabbing is sealed with a synthetic adhesive or with a piece of foiled geotextile to achieve complete waterproofness. Thereafter the meshes of the net are filled with earth, gravel, rocks and covered with a thin layer or conreted.

Mode of application of any embodiment of the invention will be determined by the importance of the earthwork of establishment intended to be protected, as well as character and extent of the stress to be expected.

Figure 2:
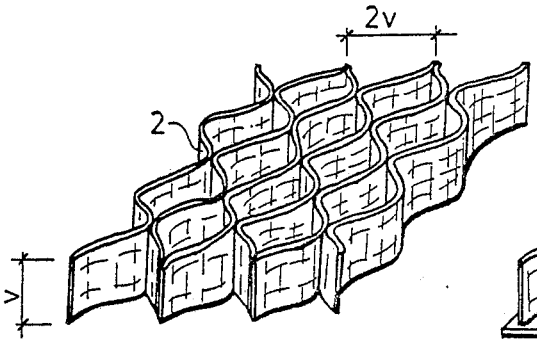
Figure 3:
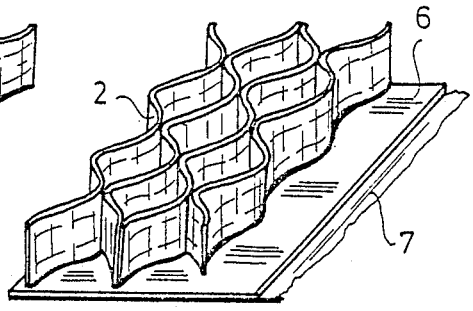

The invention will be described in detail by means of a preferred embodiment serving as example, by the aid of the drawings enclosed, wherein:

FIG. 1 is a possible embodiment of the layer structure according to the invention in a built-in state, FIGS. 2 and 3 illustrate two possible embodiments of the spatial net to be built-in.

As it is to be seen in FIG. 1, the net 2 - made of a suitable geotextile - is spread and stretched onto the surface of the earthwork 1, in our case a dike. The net thus stretched is fixed to the soil to be protected by means of the metal, synthetic or wooden stakes 3, which are stabbed into the soil through the meshes of the net and so, that net walls should be always perpendicular to the surface. The fixing stakes 3 are to be stabbed or rammed into the soil so, that the top thereof should reach to the upper plane of the net, while its lower end should lie in e depth which corresponds to the double thickness of the net.

It goes without saying that this defines also the length of the fixing stakes.

In the meshes of the net—running perpendicularly to the surface—filler 4 is filled in mechanized or with manual shoveling, so earth, humus, gravel, rock etc. properly compacted.

Above the net thus filled a protective layer 5 is spread in a thickness of 5 to 10 cm, e.g. grassed humus or concrete.

FIG. 1 illustrates a layer having been formed in the dike-body, in the dam by the aid of the spatial net, being resistant to soil-mechanical stresses.

With this embodiment the net is stretched on the horizontal or nearly horizontally formed surface, fixed by means of the stakes, whereafter the meshes of the net are filled and compacted with the material of the dam or dike.

FIGS. 2 and 3 show the net made of geotextile, as two possible formations of the structure.

One of the embodiments as to be seen in FIG. 2 is made of strips of a suitable geotextile, the width of which corresponds to the thickness of the net, indicated with V=10 to 40 cm in the drawing, two confining meshwalls are interconnected by gluing or welding. When stretched and laid on the earth, the net forms pockets of greater horizontal width than the height of the net. As indicated in FIG. 2, for example, the net forms pockets having a height of "V" and a width of "2V".

Length and width of the net should be chosen in compliance with the size of the surface to be protected. The net can be made of a plurality of pieces and glued or welded in situ.

FIG. 2 shows a further possible embodiment of the invention. In this case the net 2 is glued onto a geotextile carpet 6, while a waterproof foil 7 made of PVC or PE is glued on the rearside of the geotextile carpet 6. This embodiment can be successfully used for protecting dam bodies in course of flood protection.

The structural element according to FIG. 3 may be arranged and fixed to the surface of the earthwork 1 in a similar manner, as described in connection with FIG. 1, however, additionally the stabbing places of the stakes 3 are to be glued on the carpet to eachieve waterproof sealing.

The excellent properties of the structure according to the invention can be well utilized on several fields of application, it may gain particular importance with objects of hydraulic construction and traffic, where the surface of the soil and earthworks, respectively, is to be protected against the harmful external effect of precipitation, wind etc.

A special advantage lies in that the structure according to the invention is flexible, it is capable of following consoildation processes of the soil or earthwork, smaller movements of the earth without getting damaged.

A further advantageous feature lies in that basic material of the net and the net itself can be manufactured from available domestic materials, in a rolled state it can be easily delivered due to the small volume and low weight, it can be installed quickly and with a small expenditure of live labour.

What we claim:

1. A flexible layer structure for protecting earthworks and the like, which comprises (a) a spatial net comprising a plurality of elongated strips of material joined in spaced-apart, limited areas, (b) said spatial net being stretched out in width to form a honeycomb-like structure, with said elongated strips standing on edge, (c) said spatial net being laid out over a surface to be protected with the adjacent strips defining upwardly opening pockets, (d) a plurality of stake-like mechanical fasteners driven into said surface to be protected and projecting upward therefrom into certain of said pockets, (e) said pockets being filled with material to form a surface crust, (f) said spatial net being glued onto an underlying carpet-like layer made of geotextile, (g) the surface of the carpet facing the soil being covered with a foil, thus forming a waterproof protective crust.

2. A flexible layer structure for protecting earthworks and the like, which comprises (a) a spatial net comprising a plurality of elongated strips of material joined in spaced-apart, limited areas, (b) said spatial net being stretched out in width to form a honeycomb-like structure, with said elongated strips standing on edge, (c) said spatial net being laid out over a surface to be protected with the adjacent strips defining upwardly opening pockets, (d) a plurality of stake-like mechanical fasteners driven into said surface to be protected and projecting upward therefrom into certain of said pockets, (e) said pockets being filled with material to form a surface crust, (f) the horizontal width of said pockets being greater than the height of said net.

3. A flexible layer structure for protecting earthworks and the like, which comprises (a) a spatial net comprising a plurality of elongated thin, flat strips of flexible material oriented on edge and joined flat side to flat side in longitudinally spaced-apart, limited areas, (b) said spatial net being stretched out in width to form a honeycomb-like structure, with said elongated flat strips standing on edge, (c) said stretched out spatial net being laid out over a surface to be protected, with the adjacent strips, in the regions between joined areas thereof, defining upwardly opening pockets adapted to receive loose material.

4. A flexible layer structure as claimed in claim 3, further characterized by (a) said thin flat strips having a width of about 10–40 cm.

* * * * *